US005683095A

United States Patent [19]

Astier et al.

[11] Patent Number: 5,683,095

[45] Date of Patent: Nov. 4, 1997

[54] INTERFACE BETWEEN FRONT AND REAR SKI BINDINGS

[75] Inventors: Lionel Astier, Seynod; Benoit Saillet, Albens, both of France

[73] Assignee: Salomon S. A., Annecy, Cedex, France

[21] Appl. No.: 239,397

[22] Filed: May 6, 1994

[30] Foreign Application Priority Data

May 6, 1993 [FR] France ..... 93 05610

[51] Int. Cl.[6] ..... A63C 5/07

[52] U.S. Cl. ..... 280/602; 280/607; 280/618

[58] Field of Search ..... 280/602, 607, 280/609, 617, 618, 633, 634, 615

[56] References Cited

U.S. PATENT DOCUMENTS

| | | | |
|---|---|---|---|
| 3,797,844 | 3/1974 | Smolka | 280/607 |
| 4,804,200 | 2/1989 | Kuchler | 280/602 |
| 4,896,895 | 1/1990 | Bettosini | 280/607 |
| 5,135,250 | 8/1992 | Abondance et al. | 280/618 |
| 5,242,188 | 9/1993 | Bigler et al. | 280/618 |
| 5,342,078 | 8/1994 | Stepanek | 280/602 |
| 5,344,176 | 9/1994 | Trimble | 280/618 |

FOREIGN PATENT DOCUMENTS

| | | |
|---|---|---|
| 409 749 | 1/1991 | European Pat. Off. . |
| 492 658 | 7/1992 | European Pat. Off. . |
| 2 654 635 | 5/1991 | France . |
| 93/01869 | 2/1993 | WIPO . |

OTHER PUBLICATIONS

Search Report FR 93 05610.

*Primary Examiner*—Anne Marie Boehler
*Attorney, Agent, or Firm*—Pollock, VandeSande & Priddy

[57] ABSTRACT

Interface device between a ski and front and rear bindings (3, 4), designed to hold in place the ends of a boot on the ski. The device comprises a longilinear plate (15), each end of which is fastened to the ski to the front and rear of the bindings. One end (16) of the plate is attached to the ski. The other end (23) of the plate is movable in relation to the ski, and linkage (24) exerts a force against a block (20) fastened to the ski, thereby pretensioning the plate (15) under traction, and, by reaction, prestressing the central portion of the upper ski surface under compression. Preferably, this pretensioning ceases beyond a determinate ski flection.

18 Claims, 5 Drawing Sheets

INTERFACE BETWEEN FRONT AND REAR SKI BINDINGS

FIELD OF THE INVENTION

The invention concerns an interface device between a ski and front and rear bindings designed to hold a boot supported on the ski.

The invention also relates to a ski equipped with this interface device and to bindings linked to this interface device.

BACKGROUND OF THE INVENTION

A ski boot is normally held supported on the ski by means of a front and a rear binding, each of which holds in place an end part of the sole of the boot. Bindings are usually mounted directly on the upper ski surface.

It is known that, during skiing, the performance of the ski on the snow is affected by the distribution of pressure generated by the sliding ski surface on the snow and along the ski. Accordingly, a distribution of pressure concentrated in the central area of the ski, or runner, where the boot is positioned allows the ski to pivot greatly. On the other hand, a pressure distribution of lesser intensity in the central area and extending further in the direction of the front and rear of the ski enhances ski control.

Distribution of the pressure exerted by the ski on the snow is dependent on the inner structure of the ski, i.e., on its flexibility. It also depends on the action exerted by the bindings on the ski. This pressure distribution is further affected by the skiing phase in which the skier finds himself at any instant, in particular, the turn-initiation or the steering phases. In these phases, in fact, the skier skis by using his weight or the impulses he transmits to the ski. Moreover, ski curvature is variable.

Attempts have been made to produce different types of interfaces positioned between the bindings and the ski, in order to change the reaction of the ski to stresses generated by the skier and by the ground on which the ski slides.

For example, one interface device is disclosed by patent application Ser. No. WO 83/03 360. This device comprises a plate on which the bindings are mounted and beneath which an elastically-compressible material is installed. One end of the plate is attached to the ski while the other can slide freely against the elastic return force generated by small blocks of a compressible material.

This device proves satisfactory, but transmission of stresses between the boot and the ski is not optimal. Indeed, vertical stresses travel largely through the ends of the plate, which are offset in relation to the ends of the boot. Furthermore, this device functions passively; i.e., it exerts no action when the ski is horizontal, but gradually intensifies its effect as the ski bends.

In addition, DE-OS 2 259 375 describes a device incorporating a spring-leaf assembled to the ski at each of its ends. The bindings are assembled to the spring-leaf, which prestresses the beam forming the ski in reverse flection, thereby concentrating the pressure of the ski on the snow beneath the runner. This spring-leaf makes the ski able to pivot to a greater degree. However, its effect on the ski varies as the vertical position of the boot above the ski changes.

Another disadvantage of this device is that the boot is insulated from the ski over its entire width by virtue of a layer of a deformable material. In addition, the stresses travelling between the boot and ski are partially filtered out by this damping layer and partially transmitted to the ski through the two ends of the spring-leaf, which are positioned at an appreciable distance from the ends of the boot. In consequence, steering of the ski is not precise.

SUMMARY OF THE INVENTION

One of the objects of the present invention is to propose an interface device providing effective transmission of the ski-steering stresses between the boot and the ski.

Another object of the present invention is to propose an interface device which effectively damps ski flection in a vertical and longitudinal plane and which ensures precise transmission of the steering stresses generated by the boot on the ski when turns are initiated and during the steering phase.

A further object of the present invention is to propose an interface device which exerts a non-nil action when the ski is in a horizontal position.

Another object of the present invention is to propose an interface device whose action on the ski can be adjusted.

Other objects and advantages of the invention will be revealed during the following description, which is, however, provided for non-limiting, explanatory purposes.

The interface device according to the invention comprises a longilinear plate, each of whose ends is attached to the ski, this plate incorporating at each of its ends an assembly area for receiving attachment of the bindings, one so-called "first" end of the plate being integrally assembled to the ski.

The other, so-called "second" end is movable in relation to the ski and can travel in relation to the ski in only one longitudinal direction during flective motions of the ski.

This device is characterized by the fact that the plate is rigid when flexed and substantially plane; that its extends above the upper ski surface and parallel to it; and that connection means acting longitudinally limit traction of the plate while being supported on the ski, and, by reaction, restrict the compression of the ski in the area of the plate, at the upper surface thereof.

BRIEF DESCRIPTION OF THE DRAWINGS

The invention will emerge more clearly by referring to the description below and to the attached drawings constituting an integral part thereof.

FIGS. 3A and 4A illustrate the operation of the interface device in FIG. 1 while FIGS. 3B and 4B show details of FIGS. 3A and 4A, respectively.

DESCRIPTION OF THE PREFERRED EMBODIMENT

Figure 1:
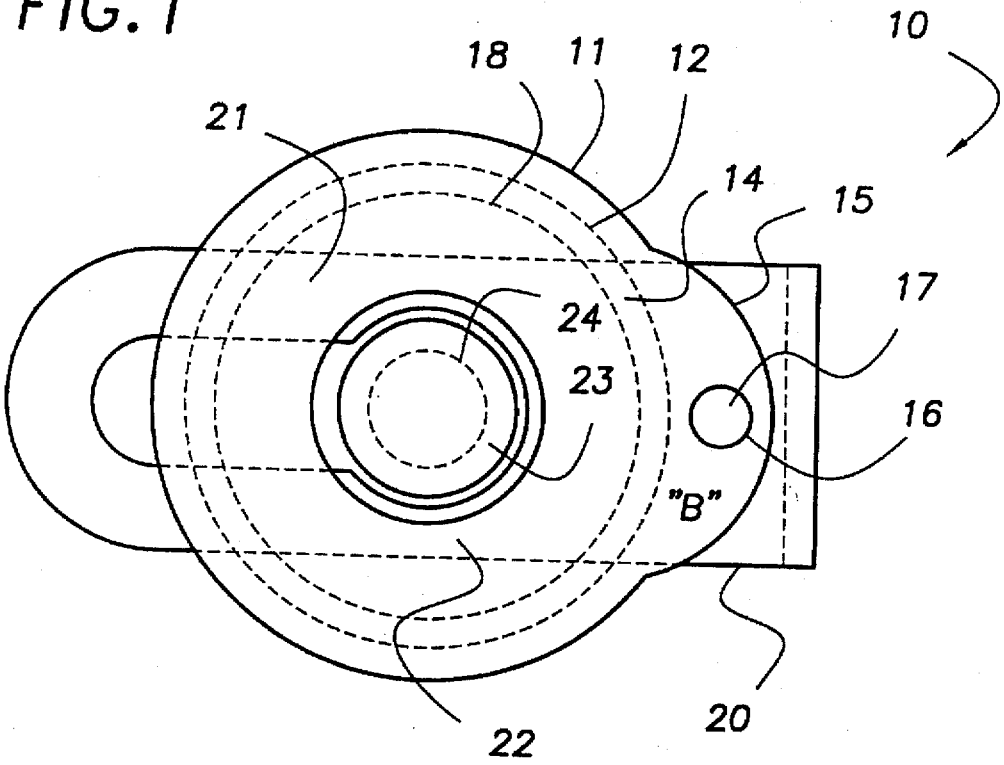
FIG. 1 is a lateral cross-section view of the runner area of a ski equipped with bindings, and of an interface device according to a first embodiment of the invention.

FIG. 1 illustrates the central portion of a ski, in which, in conventional fashion, a boot 2 is held in place supported on the ski 1 by a front binding 3 and a rear binding 4.

Conventionally, the front binding 3 incorporates a jaw 5 for holding the front end of the boot in position. This jaw 5 is carried by a body 7 connected to the ski by means of a base 8. As illustrated in FIG. 1, the base 8 is extended rearward by a support plate 9 on which the front portion of the sole of the boot rests.

Similarly, the rear binding 4 incorporates a jaw 10, supported by a body 11, for holding the rear end of the boot in place. The body 11 is, in turn, attached to the ski by means of a base 12, which incorporates a support plate 13 in its front part, on which the rear end of the sole of boot is supported.

The body 11 is mounted conventionally so as to slide along the base 12, and a spring resists the rearward motion of the body produced when the boot is inserted in the bindings and, subsequently, when the ski is flexed. In conventional fashion, when acted upon by this spring the sole of the boot is squeezed between the jaw 5 belonging to the front binding and the jaw 10 belonging to the rear binding. This force is also transmitted by reaction to the bases 8 and 12 of the front and rear bindings and their respective supports.

The front and rear bindings 3 and 4 are connected to the ski 1 by means of an interface device 14, which will now be described in greater detail.

Figure 2:
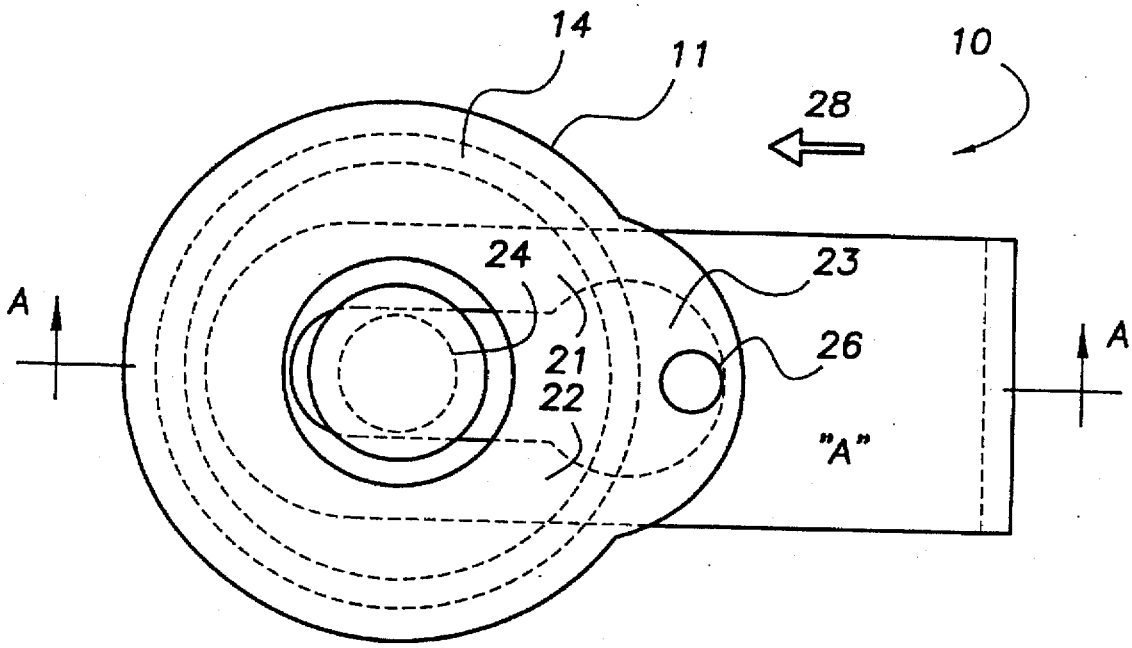
FIG. 2 is a perspective view of the interface device in FIG. 1.

The interface device comprises a longilinear plate 15 extending longitudinally between the bindings 3 and 4 and the upper ski surface. As shown in FIGS. 1 and 2, the plate 15 is plane over the greatest part of its length, and it extends parallel to the upper ski surface, while remaining raised above this surface by a uniform height.

The plate 15 is inextensible and preferably exhibits high resistance to flection and torsion. It is made of any suitable material, such as of an aluminum alloy or composite material. Of course, its structure may be lightened in spots by means of holes and can be strengthened in spots by ribs or any other suitable means.

The front portion of the plate 15 incorporates a front assembly area 15*a* designed to receive attachment of the base 8 of the front binding 3. Similarly, the rear portion of the plate 15 incorporates an assembly area 15*b* designed to receive attachment of the base 12 of the rear binding 4. The front and rear bindings 3 and 4 are thus attached to the plate 15 by means of their respective bases. Because the two binding bases are mounted on the plate 15, the thrust exerted by the rear binding is absorbed by the plate and is not transmitted to the beam of the ski 1.

The front and rear parts of the plate 15 are fastened to the ski. The rear portion of the plate 15 incorporates a depressed end 16 which barely touches the upper surface of the ski. The end 16 is integrally attached to the ski using any suitable means, for example using screws as illustrated diagrammatically at 17. Of course, this arrangement is not restrictive, and any other means of attachment of the rear end of the plate to the ski is suitable. For example, the rear part of the plate could incorporate a shoe, or block, which held it raised off of the ski. Attachment would, in this case, be effected by screws passing through the plate and the block or shoe. This block could also be positioned beneath the base 12 of the rear binding.

The front end of the plate is movable relative to the ski in the longitudinal direction delineated by the ski. Since the plate is raised off the upper ski surface, relative motion is produced between the front end of the plate and the upper ski surface when the ski is flexed.

Furthermore, the front end of the plate is connected to the ski or to an element fastened to the ski, using linkage means. In accordance with the invention, these means produce tractive prestressing in the plate and, by reaction, compressive prestressing of the central area of the ski on the upper surface.

These means are preferably produced so as to generate in the plate prestress whose effect is canceled out beyond a determinate level of ski flection. In other words, and in particular when a turn is made, this prestress acts to intensify, in the central area of the ski, the pressure of the ski on the snow in the turn-initiation phase. The ski is thus able to pivot more effectively. During the steering phase, the ski flexes. The effect produced by initial prestress of the linkage means is canceled out, and the distribution of the pressure generated by the ski on the snow is similar to that of a conventional ski.

According to a preferred embodiment of the invention, in the event of over-turning, which causes pronounced ski flection, the linkage means act once again on the plate 15, but with the effect of restricting the pressure it generates. The plate then acts like a stiffener of the central portion of the ski. The intensity of the pressure of the ski on the snow diminishes in the central portion of the ski and is transmitted to each of the ends of the ski.

Advantageously, the plate 15 is horizontal above the ski over the greatest part of its length. In addition, the prestressing and stressing actions exerted by the linkage means on the plate and the ski are generally directed horizontally and longitudinally.

According to a first embodiment, illustrated in FIGS. 1 and 2, the linking means are placed at the front end portion of the plate 15.

In this area, a block 20 is interposed between the upper ski surface and the plate. The block 20 has a substantially-uniform thickness, at least over one part of its length; over this part of its length, it provides a surface which supports the plate 15 vertically.

The block 20 is fastened to the ski using any suitable means, e.g., by using screws or adhesive bonding. For illustration purposes, FIG. 2 shows orifices 21 which pass completely through the plate 15, thereby allowing access to the screw assembling the block 20 to the ski.

The front portion of the block 20 has a vertical, transverse surface 22, whose function will be described below.

The front part of the plate 15 extends beyond the transverse surface 22. At this point, it has a shoulder 23 directed toward the upper ski surface. The figures show the shoulder 23 existing as a bend of the plate. The shoulder 23 could also be formed by a block attached to the front end of the plate. The shoulder 23 is of a height sufficient to cover the surface 22 over at least one part of its height.

Between the shoulder 23 and the surface 22, the linkage means comprise means which function by means of thrust; i.e., they tend to move the shoulder 23 and the block 22 apart. In FIGS. 1 and 2, these means are represented as two screws 24 and 25, which are screwed into threaded holes in the shoulder 23 set parallel to the longitudinal axis of the ski.

In front of the shoulder 23, the screws incorporate a head allowing them to be manipulated. To the rear of the shoulder, the screws have a support end designed to be supported simply against the surface 22 of the block 20, so as to form a one-directional thrust linkage.

The screws 24 and 25 extend along the longitudinal direction of the ski. They can be screwed and unscrewed so as to travel longitudinally as one unit. Moreover, they are higher than the upper ski surface, so that their area of support on the surface 22 is higher than this upper ski surface. In the embodiment shown, the screws are positioned mid-way between the plate and the upper ski surface. This arrangement is not, however, restrictive.

By screwing in the screws to a greater or lesser extent, a thrust stress is generated between the ends of the block 20 and the shoulder 23. The intensity of this stress varies depending on the longitudinal position of the screws 24 and 25. This intensity is also determined by the height of the screws 24 and 25.

According to a preferred embodiment of the invention, the longitudinal position of the screws is determined in such a way that, when the ski is horizontal, in particular in the turn-initiation phases, the screws are supported on the surface 22 and generate stress; and, when the ski is flexed, in particular in the steering phases, the screws are withdrawn from their support position on the surface 22, so that the stress which they produce is canceled out accordingly. In fact, when the ski flexes, the front end of the plate carrying the screws 24 and 25 moves forward in relation to the block 20, which forms the support for the screws 24 and 25.

Under these conditions, the screws are adjusted in the following manner. Beginning at a resting position of the ski and a position in which the screws 24 and 25 are flush and in the absence of stress on the surface 22, the screws 24 and 25 are offset toward the rear of the ski by a distance less than or equal to the amplitude of the relative longitudinal movement between the shoulder 23 and the block 20 produced when the ski flexes to a degree similar to that reached during turn-control phases.

Of course, any suitable means can be used to lock, as required, the screws in their desired longitudinal position; e.g., a lock nut when a threaded screw is used.

Figure 3:
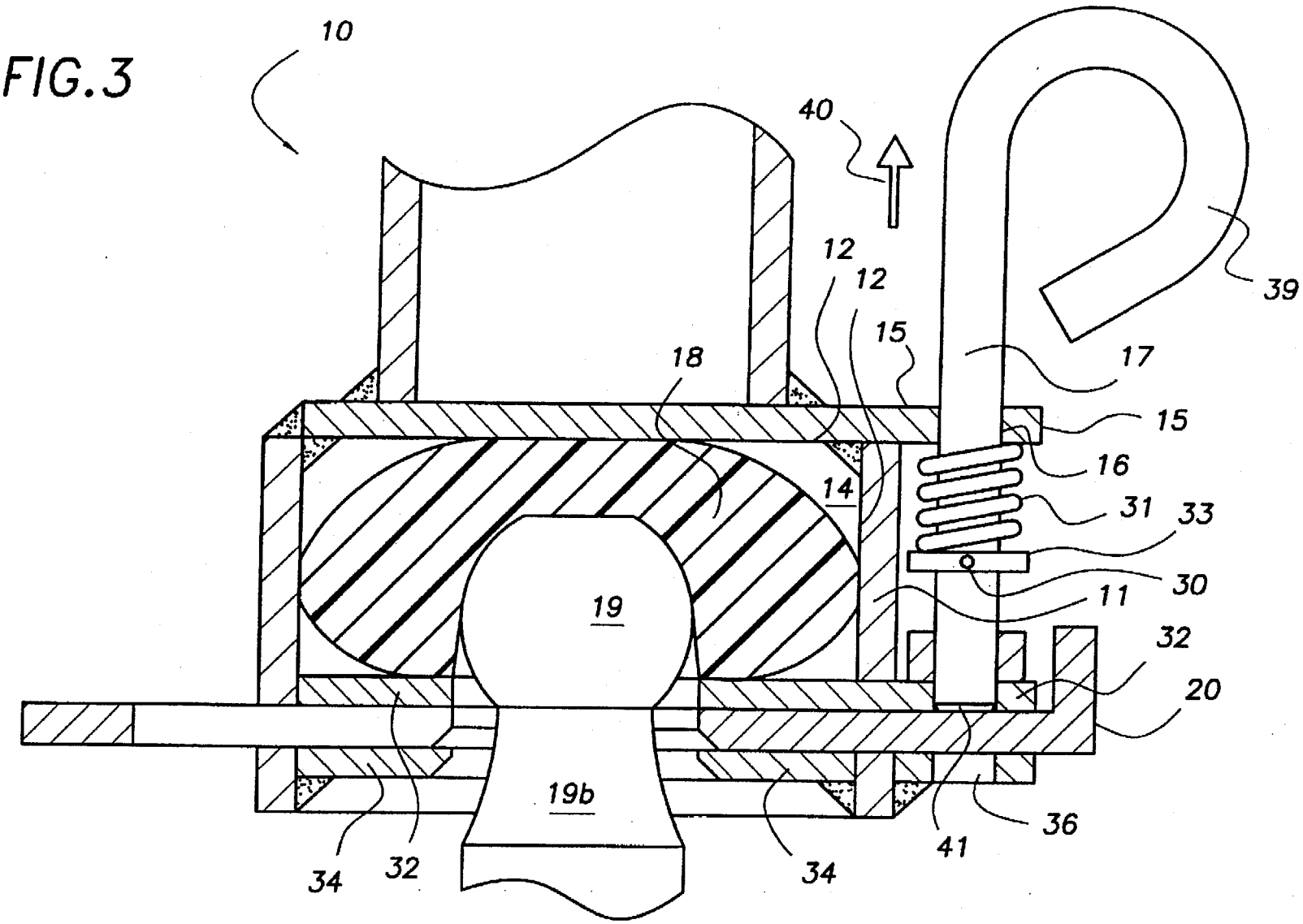
Figure 4:
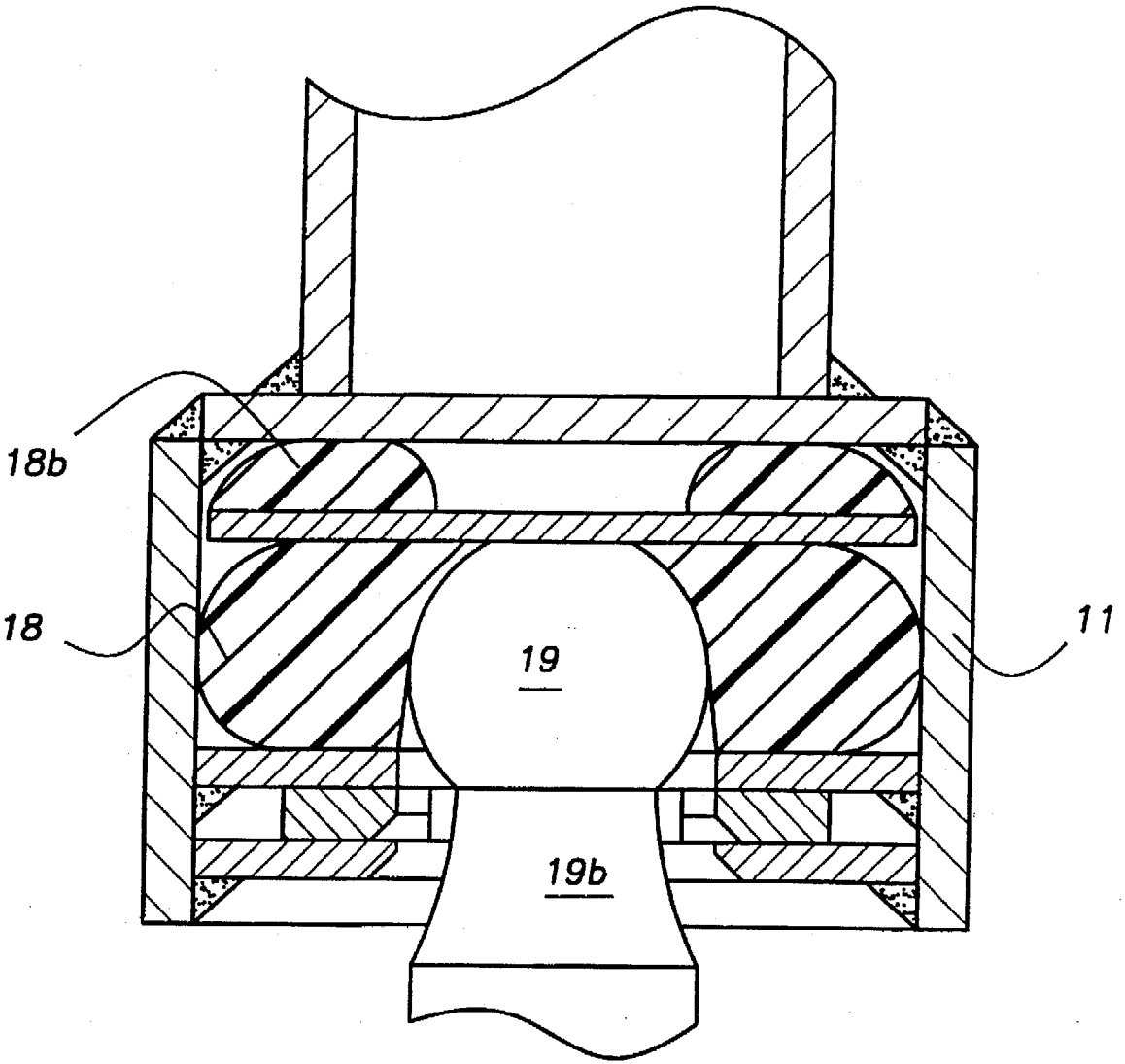

FIG. 3 illustrates the resting position of the ski 1, in which the screws 24 and 25 are supported under prestress against the block 20. FIG. 4 illustrates the ski undergoing the flection produced during the steering phases. In this configuration, the screws 24 and 25 are withdrawn from their support on the surface 22, and the prestress effect they produce is canceled out.

In the preferred embodiment shown in FIGS. 1 and 2, the central portion of plate 15 has, oblong orifices 30 oriented longitudinally and which are distributed over the plate surface. These orifices 30 pass completely through the plate. They are shouldered and cooperate with washers 31, whose oblong shape is shorter than the length of the orifices 30 and a substantially equal width. The washers 31 are also shouldered. They are fastened to the ski using any suitable means, e.g., using screws 32. The washers 31 are intended to guide the plate 15 along its entire surface, by permitting its motion in a longitudinal and horizontal direction, while at the same time preventing any other lateral or vertical movement in relation to the ski.

This arrangement is not restrictive, and any other suitable means ensuring longitudinal guidance of the front part of the plate, e.g. a slide-track would be appropriate.

In addition, the front part of the block 20 preferably incorporates, beneath the plate 15, a recess filled with a layer of a damping material 33. This layer adheres to the block 20 and to the lower surface of the plate 15. Its function is to damp the longitudinal motion of the front end of the plate in relation to the ski, by becoming deformed under shearing action.

The layer 33 is constituted, for example, by a damping material possessing viscoelastic properties.

The recess filled with the layer 33 is preferably located in front of the base 8 of the front binding. However, it may extend beneath the base along the mid-point of the width of the plate, while leaving a direct contact between the lateral edges of the plate and the block 20. Accordingly, there is direct transmission of the stresses and steering signals transmitted by the skier to the ski along the lateral edges of the block and toward the ski edges.

Furthermore, according to the embodiment shown in FIGS. 1 and 2, a layer of a damping material 35 is inserted between the plate 15 and the upper ski surface.

The layer 35 is placed mainly beneath the rear binding 4, in particular beneath the support plate 13.

The vertical stresses generated by the boot, in the heel area, travel partially through this layer. The other part of the stresses is distributed toward the front and rear of the plate.

The greater the hardness of the layer 35, the greater the concentration of the stresses beneath the heel. Conversely, if the hardness of the layer 35 is low, the stresses will be distributed to a greater extent beneath the surface of the plate.

This layer 35 thus produces an effect which complements that generated by the linkage means.

Dynamically, the layer 35 allows vertical damping of vibrations and shocks beneath the heel.

Figure 5:
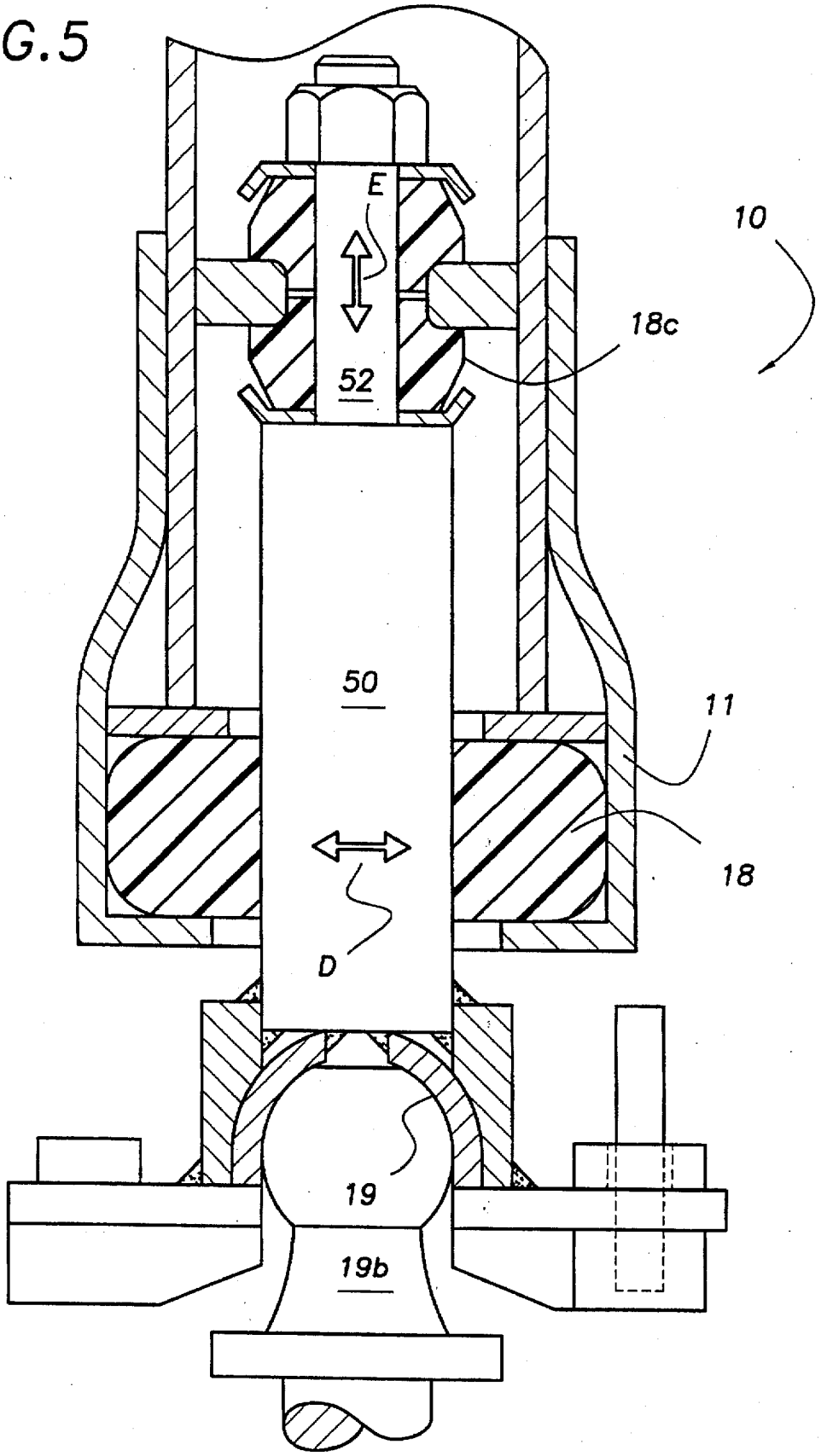
FIG. 5 is a partial view of the front part of an interface device, illustrating a second embodiment of the invention.

FIG. 5 illustrates a variant of the invention, according to which the linkage means comprise one or several screws 40 which pass freely through a hole 41 in the shoulder 23 and which are screwed into a threaded hole 42 in the block 20. Between the shoulder 23 and the block 20, the screw 40 supports a nut or, a ring 44, whose longitudinal position is adjustable. To the outside of the shoulder 23, the screw 40 incorporates a head 45 whose longitudinal position can also be adjusted by screwing or unscrewing the screws.

The nut 44 and the portion of the screw 40 located in the direction of the block 20 perform a function similar to that of the aforementioned screws 24 and 25. In other words, beginning with a resting position of the ski and a support position created by making the nut 44 flush against the shoulder 23, the nut 44 travels longitudinally toward the shoulder 23 by a determinate distance, so as to exert on the plate 15 a tractive stress while being supported on the block 20. Depending on the position of the nut 44 along the screw 40, this stress is canceled out fairly soon when the ski is flexed.

When the ski is at rest, the head 45 is withdrawn forward in relation to the shoulder 23. During ski flection, the shoulder 23 undergoes longitudinal motion in relation to the block 20. In the event of significant flection of the ski, the shoulder 23 comes to rest against the head 45 and is then held in place by this head. The connection means thus generate within the plate a compressive stress, and the plate 15 then acts on the ski in the manner of a stiffener of its central area.

By screwing and unscrewing, the longitudinal position of the head 45 in relation to the shoulder 23 can be adjusted. Preferably, when the ski is at rest, this distance is greater than the distance travelled by the nut 44 producing the prestress, but smaller than the amplitude of the relative movement between the shoulder 23 and the block 20, which occurs when the ski is strongly or very strongly stressed. Thus, when over-turning occurs, ski flection intensifies, the head 45 then becomes functional, and the plate 15 acts as a stiffener, thereby improving momentarily the guidance properties of the ski.

Figure 6:
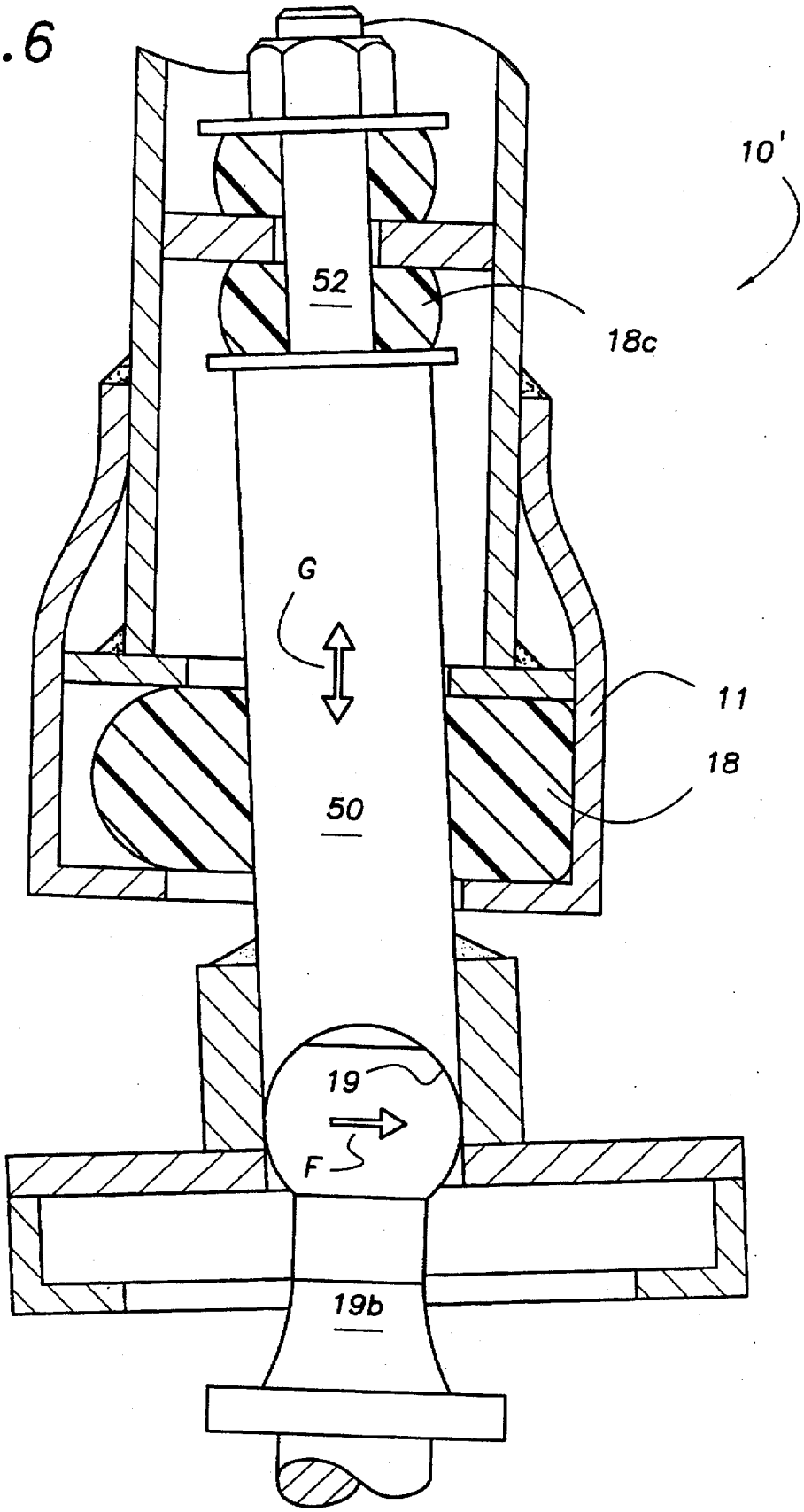
FIG. 6 is a view similar to FIG. 5, illustrating a third embodiment of the invention.
Figure 1:
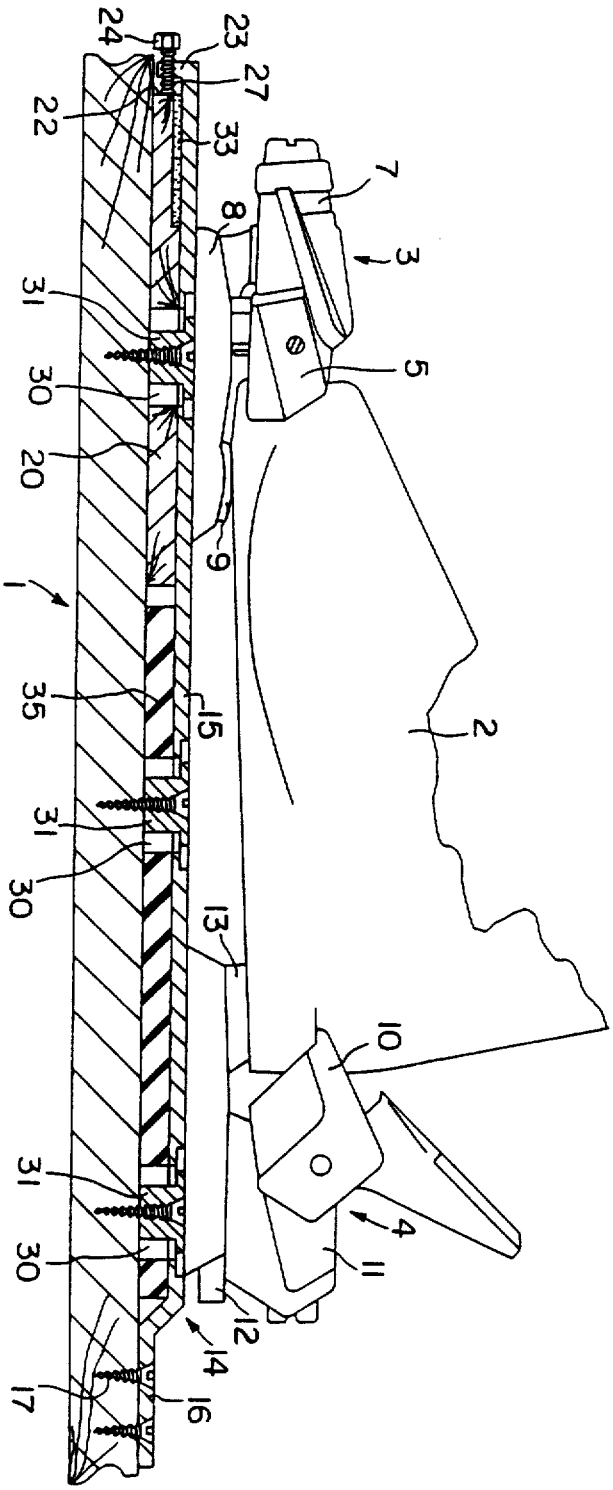
Figure 2:
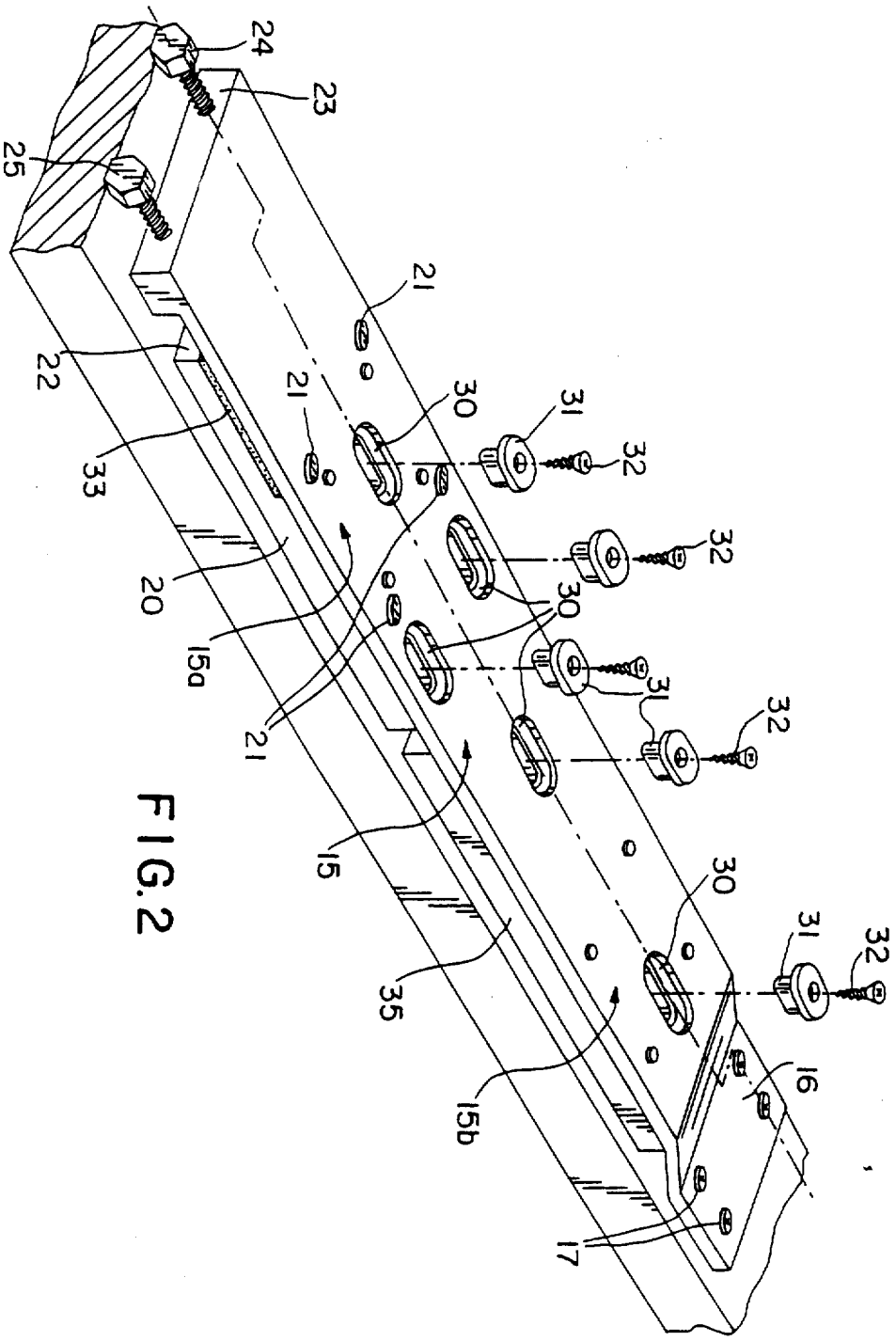
Figure 5:
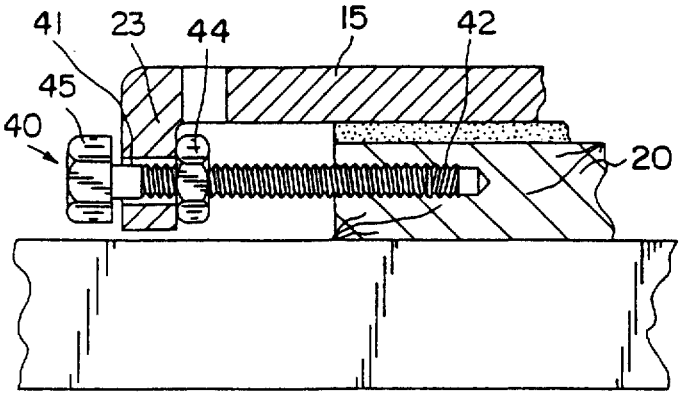
Figure 6:
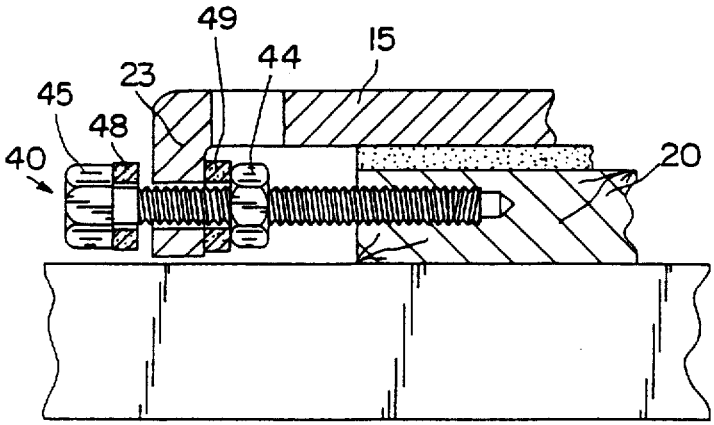

FIG. 6 illustrates a variant in which washers made of a damping material 48 and 49 are interposed between the head 45 and the shoulder 43 and between the nut 44 and the shoulder 23, respectively. These washers make more gradual the changes occurring between the various modes of action of the linkage means on the ski.

Of course, a single washer, placed on either side of the shoulder, could also be used.

The linkage means functioning between the plate 15 and the ski are not restricted to the different embodiments described.

Figure 7:
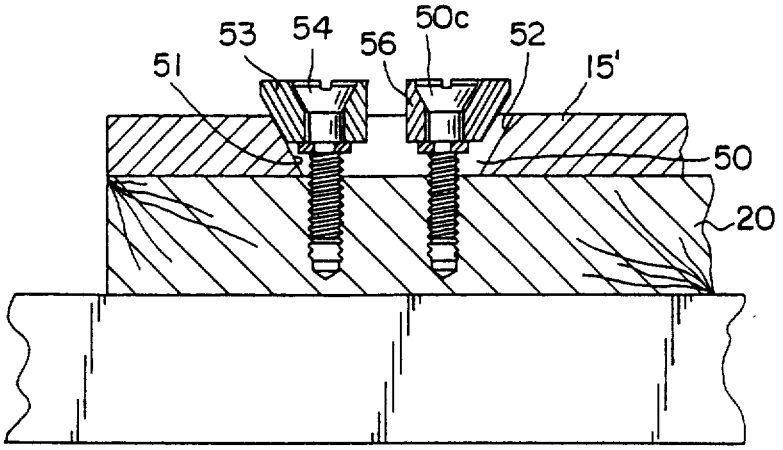
FIGS. 7 and 8 illustrate a fourth embodiment of the invention.
Figure 8:
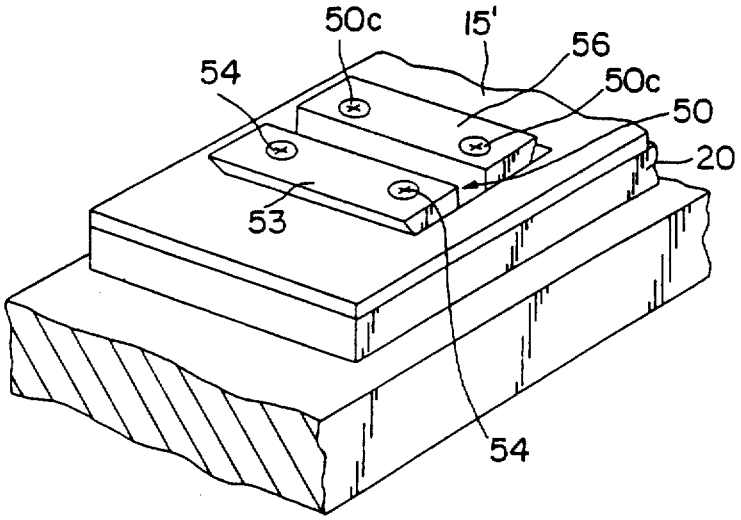

Accordingly, FIGS. 7 and 8 illustrate a variant, in which the front part of the plate 15, has a transverse orifice 50, which is delimited to the front and rear by two inclined surfaces 51 and 52.

A bevelled block 53, whose height is adjusted using screws 54, is positioned in the front part of the orifice 50. This bevelled block acts on the inclined surface 51 and generates on the plate 15*a* an effect similar to that of the screws 24 and 25 or that of the nut 44.

Similarly, the height of a bevelled block 56 positioned to the rear of the orifice 52 can be adjusted using screws 54, 57. When the ski is at rest, the block 56 is withdrawn from the inclined surface 52 of the orifice 50, but is provided in order to engage this surface during strong flection of the ski. This block 56 performs the same function as the heads 45 of the screws described above. Preferably, the inclination of the surfaces 51 and 52 is determined in such a way that the orifice 50 flares upward.

What is claimed is:

1. Interface device adapted to be inserted between a ski and front and rear bindings retaining ends of a boot on said ski, said device comprising (a) a longilinear plate adapted to be positioned atop a central portion of a ski, said plate being inextensible and rigid in flexion and having first and second ends adapted to be connected to said ski;

(b) said plate having toward one end thereof a front mounting zone for attachment of a front binding, and a rear mounting zone for receiving a rear binding;

(c) a first end of said plate being adapted for rigid attachment to said ski, while a second end of said plate is movable relative to said ski solely longitudinally of said ski during flexion of said ski;

(d) a block being adapted to be attached to said ski under said second end of said plate; and (e) a first support stop establishing a unidirectional support connection between said second end of said plate and said block such that said plate is constrained in traction and, in reaction, said central portion of said ski between said block and said first end of said plate is constrained in compression when said ski is at rest.

2. Device according to claim 1, wherein said first support stop is longitudinally adjustable.

3. Device according to claim 2, wherein said second end of said plate extends beyond said block, and beyond said block has a shoulder facing said block, said shoulder being provided with at least one threaded orifice receiving a screw having an end in abutment against said shoulder.

4. Device according to claim 2, wherein said second end of said plate extends beyond said block, and beyond said block has a shoulder facing said block, said block living opposite said shoulder at least one threaded element with a threaded portion, an end screwed into said block, and a nut movable along said threaded portion, said nut forming said adjustable stop support.

5. Device according to claim 4 wherein a washer of damping material is intercalated between said nut and said shoulder.

6. Device according to claim 2, wherein said second end of said plate has an opening in which is engaged a beveled block carried by at least one screw threaded in an upper portion of said block.

7. Device according to claim 6, including a second support stop staggered relative to said first support stop, and operative between said block and said second end of said plate so as to establish a unidirectional support connection between said second end of said plate and said block beyond only one determined longitudinal displacement path of said second end relative to said block in a direction opposite to a direction of said unidirectional support of said first support stop.

8. Device according to claim 7, wherein said second end of said plate extends beyond said block, and beyond said block has a shoulder facing said block with at least one orifice, said block having opposite said orifice at least one threaded element with a threaded portion which traverses said orifice of said shoulder, one end screwed into said block, a nut movable along said threaded portion short of said shoulder, said nut forming said support stop adjustable in position, and a head located beyond said shoulder forming said second support stop.

9. Device according to claim 8, comprising washers of damping material intercalated between said threaded element and said shoulder and between said nut and said shoulder, respectively.

10. Device according to claim 8, wherein said second end of said plate has an opening with first and second ends, a first bevelled block being engaged in said opening opposite said first end and a second bevelled block being engaged in said opening opposite said second end, each of said bevelled blocks being carried by at least one screw adjustable in height and engaged in an upper portion of said block.

11. Device according to claim 1, wherein said plate is adapted to be positioned at an elevation above an upper surface of said ski, and a layer of damping material is intercalated and fills a space between said plate and said ski over at least a part of a length of said plate.

12. Device according to claim 1, wherein said plate has at least one oblong orifice traversed by a shouldered washer shorter than said oblong orifice, said shouldered washer being adapted for solidarization with said ski.

13. Set of devices for retaining a boot supported on a ski, comprising an interface device according to claim 1, a front binding assembled to said plate in said front mounting zone, and a rear binding assembled to said plate in said rear mounting zone.

14. Ski for alpine skiing comprising an interface device according to claim 1.

15. Ski for alpine skiing comprising a set of devices for retaining a boot, as claimed in claim 13.

16. Interface device adapted to be inserted between a ski and front and rear bindings retaining ends of a boot on said ski, said device comprising (a) a longilinear plate adapted to be positioned atop a central portion of a ski, said plate being inextensible and rigid in flexion and having first and second ends adapted to be connected to a said ski;

(b) said plate having toward one end thereof a front mounting zone for attachment of a front binding, and a rear mounting zone for receiving a rear binding;

(c) a first end of said plate being adapted for rigid attachment to said ski, while a second end of said plate is movable relative to said ski solely longitudinally of said ski during flexion of said ski;

(d) a block being adapted to be attached to said ski under said second end of said plate; and (e) a longitudinally adjustable first support stop establishing a unidirectional support connection between said second end of said plate and said block such that said plate is constrained in traction and, in reaction, said central portion of said ski between said block and said first end of said plate is constrained in compression when said ski is at rest;

(f) said second end of said plate extending beyond said block, and beyond said block having a shoulder facing said block, said shoulder being provided with at least one threaded orifice receiving a screw having an end in abutment against said shoulder.

17. Interface device adapted to be inserted between a ski and front and rear bindings retaining ends of a boot on said ski, said device comprising (a) a longilinear plate adapted to be positioned atop a central portion of a ski, said plate being inextensible and rigid in flexion and having first and second ends adapted to be connected to said ski;

(b) said plate having toward one end thereof a front mounting zone for attachment of a front binding, and a rear mounting zone for receiving a rear binding;

(c) a first end of said plate being adapted for rigid attachment to said ski, while a second end of said plate is movable relative to said ski solely longitudinally of said ski during flexion of said ski;

(d) a block being adapted to be attached to said ski under said second end of said plate; and (e) a longitudinally adjustable first support stop establishing a unidirectional support connection between said second end of said plate and said block such that said plate is constrained in traction and, in reaction, said central portion of said ski between said block and said first end of said plate is constrained in compression when said ski is at rest;

(f) a second support stop staggered relative to said first support stop, and operative between said block and said second end of said plate so as to establish a unidirectional support connection between said second end of said plate and said block beyond only one determined longitudinal displacement path of said second end relative to said block in a direction opposite to a direction of said unidirectional support of said first support stop;

(g) said second end of said plate extending beyond said block, and beyond said block having a shoulder facing said block with at least one orifice, said block having opposite said orifice at least one threaded element with a threaded portion which traverses said orifice of said shoulder, one end screwed into said block, a nut movable along said threaded portion short of said shoulder, said nut forming said support stop adjustable in position, and a head located beyond said shoulder forming said second support stop.

18. Interface device adapted to be inserted between a ski and front and rear bindings retaining ends of a boot on said ski, said device comprising (a) a longilinear plate adapted to be positioned atop a central portion of a ski, said plate being inextensible and rigid in flexion and having first and second ends adapted to be connected to said ski;

(b) said plate having toward one end thereof a front mounting zone for attachment of a front binding, and a rear mounting zone for receiving a rear binding;

(c) a first end of said plate being adapted for rigid attachment to said ski, while a second end of said plate is movable relative to said ski solely longitudinally of said ski during flexion of said ski;

(d) a block being adapted to be attached to said ski under said second end of said plate; and (e) a longitudinally adjustable first support stop establishing a unidirectional support connection between said second end of said plate and said block such that said plate is constrained in traction and, in reaction, said central portion of said ski between said block and said first end of said plate is constrained in compression when said ski is at rest; and (f) a second support stop staggered relative to said first support stop, and operative between said block and said second end of said plate so as to establish a unidirectional support connection between said second end of said plate and said block beyond only one determined longitudinal displacement path of said second end relative to said block in a direction opposite to a direction of said unidirectional support of said first support stop;

(g) said second end of said plate having an opening with first and second ends, a first bevelled block being engaged in said opening opposite said first end and a second bevelled block being engaged in said opening opposite said second end, each of said bevelled blocks being carried by at least one screw adjustable in height and engaged in an upper portion of said block.

* * * * *

UNITED STATES PATENT AND TRADEMARK OFFICE

CERTIFICATE OF CORRECTION

PATENT NO. : 5,683,095
DATED : November 4, 1997
INVENTOR(S) : Astier et al.

It is certified that error appears in the above-identified patent and that said Letters Patent is hereby corrected as shown below:

The title page, showing the illustrative figure, should be deleted and substitute therefor the attached title page.
The drawing sheets, consisting of Figs. 1-6, should be deleted to be replaced with the drawing sheets, consisting of Figs. 1-8, as shown on the attached page.

Signed and Sealed this

Twenty-fourth Day of February, 1998

*Attest:*

*Attesting Officer*

BRUCE LEHMAN

*Commissioner of Patents and Trademarks*

United States Patent [19]

Astier et al.

[11] Patent Number: 5,683,095

[45] Date of Patent: Nov. 4, 1997

[54] INTERFACE BETWEEN FRONT AND REAR SKI BINDINGS

[75] Inventors: Lionel Astier, Seynod; Benoit Saillet, Albens, both of France

[73] Assignee: Salomon S. A., Annecy, Cedex, France

[21] Appl. No.: 239,397

[22] Filed: May 6, 1994

[30] Foreign Application Priority Data

May 6, 1993 [FR] France ..... 93 05610

[51] Int. Cl.[6] ..... A63C 5/07

[52] U.S. Cl. ..... 280/602; 280/607; 280/618

[58] Field of Search ..... 280/602, 607, 280/609, 617, 618, 633, 634, 615

[56] References Cited

U.S. PATENT DOCUMENTS

| | | | |
|---|---|---|---|
| 3,797,844 | 3/1974 | Smolka | 280/607 |
| 4,804,200 | 2/1989 | Kuchler | 280/602 |
| 4,896,895 | 1/1990 | Bettosini | 280/607 |
| 5,135,250 | 8/1992 | Abondance et al. | 280/618 |
| 5,242,188 | 9/1993 | Bigler et al. | 280/618 |
| 5,342,078 | 8/1994 | Stepanek | 280/602 |
| 5,344,176 | 9/1994 | Trimble | 280/618 |

FOREIGN PATENT DOCUMENTS

| | | |
|---|---|---|
| 409 749 | 1/1991 | European Pat. Off. . |
| 492 658 | 7/1992 | European Pat. Off. . |
| 2 654 635 | 5/1991 | France . |
| 93/01869 | 2/1993 | WIPO . |

OTHER PUBLICATIONS

Search Report FR 93 05610.

*Primary Examiner*—Anne Marie Boehler
*Attorney, Agent, or Firm*—Pollock, VandeSande & Priddy

[57] ABSTRACT

Interface device between a ski and front and rear bindings (3, 4), designed to hold in place the ends of a boot on the ski. The device comprises a longilinear plate (15), each end of which is fastened to the ski to the front and rear of the bindings. One end (16) of the plate is attached to the ski. The other end (23) of the plate is movable in relation to the ski, and linkage (24) exerts a force against a block (20) fastened to the ski, thereby pretensioning the plate (15) under traction, and, by reaction, prestressing the central portion of the upper ski surface under compression. Preferably, this pretensioning ceases beyond a determinate ski flection.

18 Claims, 5 Drawing Sheets

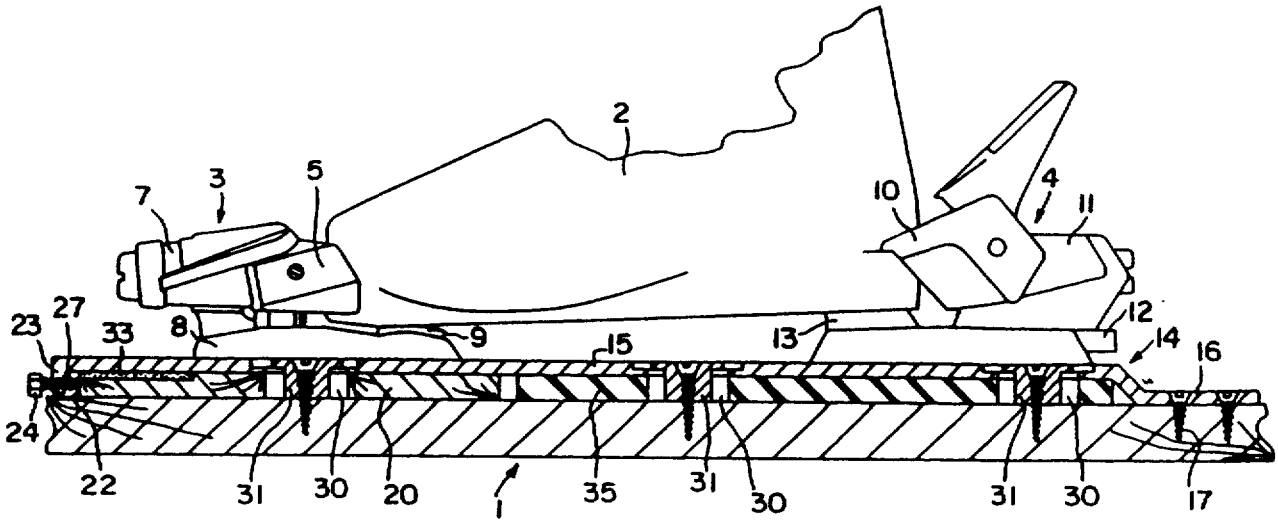

FIG. 1

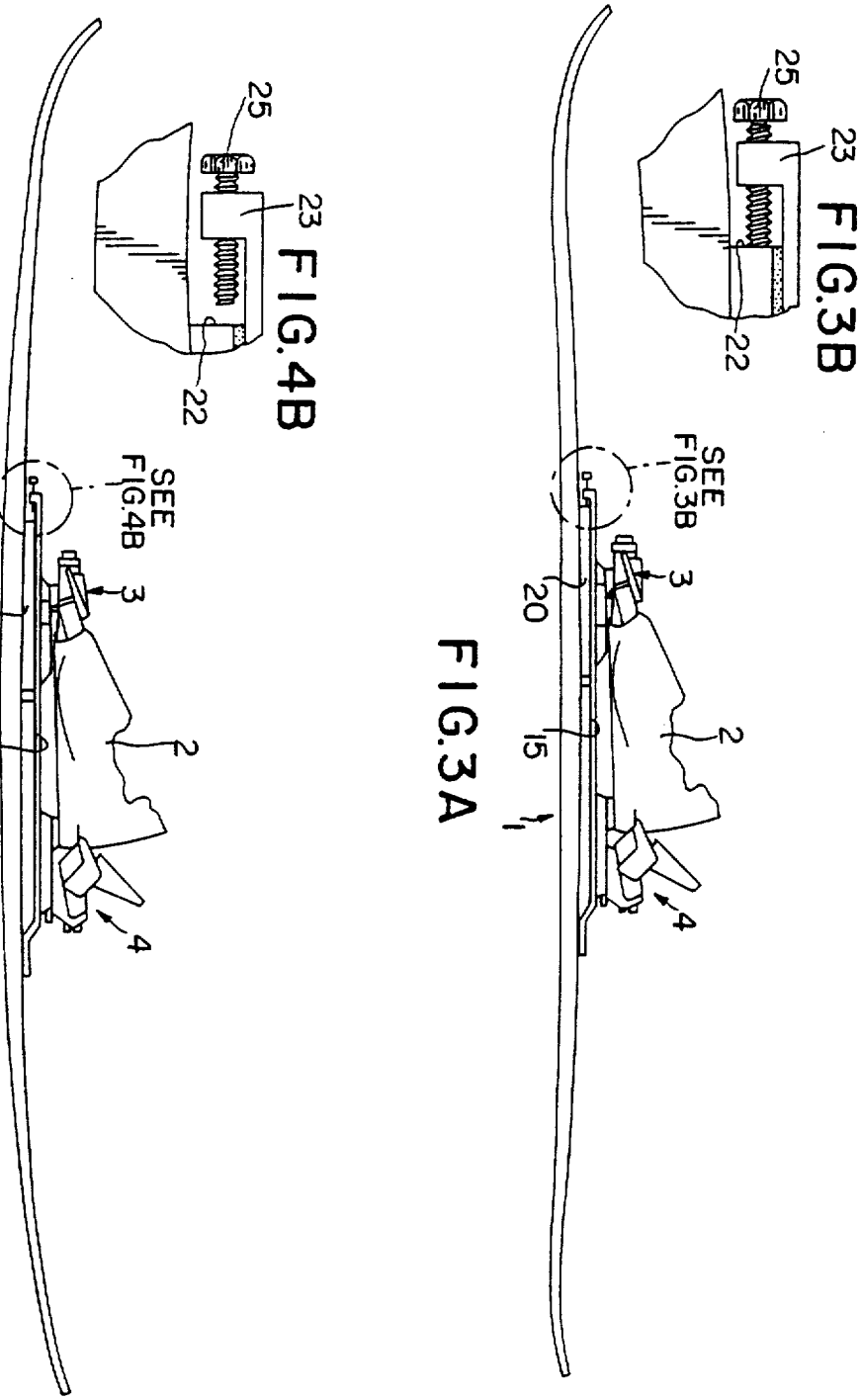
FIG.3B
FIG.3A
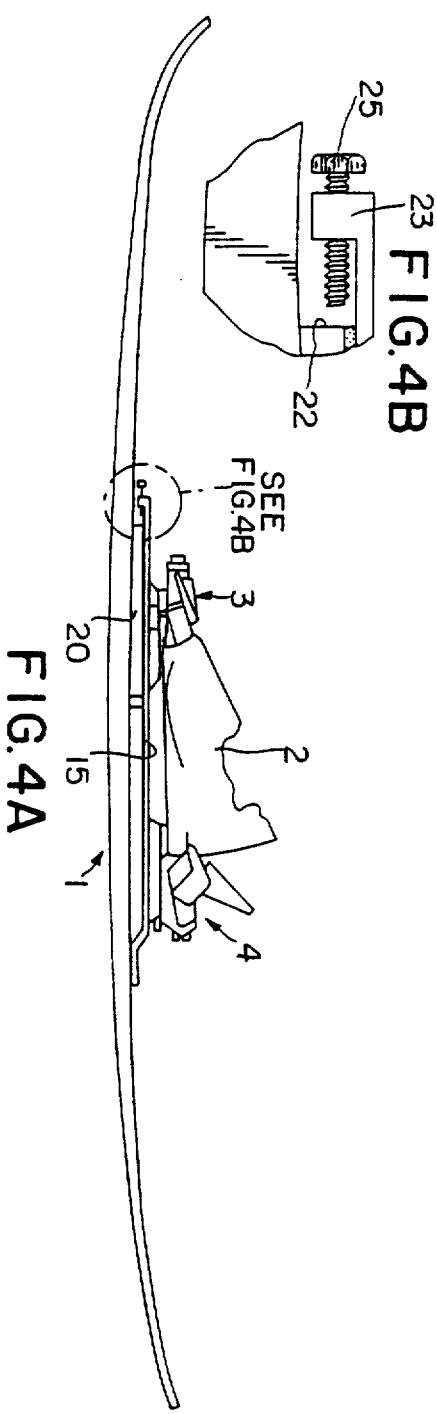
FIG.4B
FIG.4A